US005680134A

United States Patent [19]

Tsui

[11] Patent Number: 5,680,134

[45] Date of Patent: Oct. 21, 1997

[54] REMOTE TRANSMITTER-RECEIVER CONTROLLER SYSTEM

[76] Inventor: Philip Y. W. Tsui, 3513 Ingram Road, Mississauga, Ontario, Canada, L5L 4M4

[21] Appl. No.: 583,883

[22] Filed: Jan. 11, 1996

Related U.S. Application Data

[63] Continuation of Ser. No. 270,374, Jul. 5, 1994, abandoned.

[51] Int. Cl.[6] ..... G08C 19/12

[52] U.S. Cl. ..... 341/173; 341/176; 340/825.31; 340/825.73

[58] Field of Search ..... 341/173, 176; 340/825.69, 825.72, 870.02, 870.07, 825.73, 825.76, 825.31, 825.32; 455/93, 102

[56] References Cited

U.S. PATENT DOCUMENTS

| | | | |
|---|---|---|---|
| 3,579,240 | 5/1971 | Deming | 343/228 |
| 3,754,187 | 8/1973 | Deming | 325/37 |
| 3,754,189 | 8/1973 | Deming | 325/392 |
| 3,768,018 | 10/1973 | Deming | 325/67 |
| 3,823,378 | 7/1974 | Deming | 325/155 |
| 4,041,259 | 8/1977 | Deming | 200/46 |
| 4,064,487 | 12/1977 | Russell et al. | 340/168 |
| 4,103,238 | 7/1978 | Deming et al. | 325/141 |
| 4,496,942 | 1/1985 | Matsuoka | 341/176 |
| 5,252,960 | 10/1993 | Duhame | 340/825.56 |
| 5,379,453 | 1/1995 | Tigwell | 455/151.2 |
| 5,442,340 | 8/1995 | Dykema | 340/825.22 |
| 5,471,668 | 11/1995 | Soenen et al. | 455/352 |
| 5,515,052 | 5/1996 | Darbee | 341/176 |
| 5,559,810 | 9/1996 | Gilbert et al. | 455/102 |
| 5,563,600 | 10/1996 | Miyake | 341/173 |
| 5,568,122 | 10/1996 | Xydis | 340/539 |

*Primary Examiner*—Jeffery Hofsass
*Assistant Examiner*—Ashok Mannava
*Attorney, Agent, or Firm*—Blakely, Sokoloff, Taylor & Zafman LLP

[57] ABSTRACT

A transmitter-receiver controller system for remote actuation of devices or appliances such as security systems and garage door opener systems. The transmitter and receiver each utilize a programmable microcontroller for encoding and decoding signals. The device code, the data transmission format and the transmission frequency are selectable. The device code, data transmission format and the transmission frequency of the transmitter and/or the receiver can be selected to emulate other remote transmitter-receiver controller systems to enable operation of the present transmitter and receiver with those systems.

6 Claims, 12 Drawing Sheets

| | |
|---|---|
| FIG. 7A | FIG. 7B |

| | |
|---|---|
| FIG. 9A | FIG. 9B |

REMOTE TRANSMITTER-RECEIVER CONTROLLER SYSTEM

This is a continuation of application Ser. No. 08/270,374, filed Jul. 5, 1994 now abandoned.

BACKGROUND

1. Field of the Invention

This invention is directed in general to controller systems including transmitters and/or receivers which operate on a coded signal and, in particular, to a controller system in which the transmitter and receiver are capable of selectively operating with one of a plurality of coded signals at a plurality of frequencies.

2. Prior Art

Transmitter-receiver controller systems (hereinafter transmitter-receiver systems) are widely used for remote control and/or actuation of devices or appliances such as garage door openers, gate openers, security systems, and the like. For example, most conventional garage door opener systems use a transmitter-receiver combination to selectively activate the drive source (i.e., motor) for opening or closing the door. The receiver is usually mounted adjacent to the motor and receives a coded signal (typically RF) from the transmitter. The transmitter is carried in the vehicle and selectively activated by a user to send the coded signal to open or close the garage door.

Different manufacturers of such transmitter-receiver systems normally utilize different code schemes for the coded signal and may also operate their products at different transmission frequencies within the allocated frequency range for this type of system. The code scheme typically includes two aspects: 1) a device code (equivalent to a device address) for the transmitter and receiver, and 2) a transmission format, i.e., the characteristics of the transmitted signal including timing parameters and modulation characteristics related to encoded data. The code scheme used by one manufacturer is usually incompatible with the code schemes of systems produced by other manufacturers. Currently available transmitter-receiver systems typically employ custom encoders and decoders to implement the code scheme. These encoders and decoders are fabricated with custom integrated circuits such as application-specific integrated circuits (ASICs). They are, to a large degree, fixed hardware devices and allow very limited flexibility in the encoding/decoding operation or in the modification of the encoding/decoding operation.

Consequently, if a user has two or more systems from different manufacturers, multiple transmitters may be necessary to operate all of the systems. For example, if a user has multiple garages (e.g., a vacation home, an office or the like), multiple transmitters may be required to operate different systems at each location. Moreover, businesses that sell or maintain transmitter-receiver systems from more than one manufacturer must maintain an inventory of each type of device when the transmitters/receivers have distinct code transmission format or transmission frequency requirements.

To provide greater flexibility and avoid the requirement for multiple inventories, there is a need for a transmitter unit and a receiver unit which can selectively emulate the transmitters and receivers of other transmitter-receiver systems to enable the transmitter unit and/or receiver unit to operate in such other systems.

SUMMARY OF THE INVENTION

Accordingly, the present invention provides a transmitter-receiver system which may selectively operate at one of a plurality of transmission frequencies and may selectively encode/decode the transmitted data in one of a plurality of data transmission formats. Each transmitter and receiver includes a microcontroller which has been programmed to implement multiple encoding/decoding schemes and multiple data transmission formats in the unit. The microcontrollers may be programmed to implement any desired encoding/decoding scheme including the capability of emulating the encoding/decoding schemes and data transmission formats of transmitter-receiver systems currently in common use. The encoding/decoding scheme, the data transmission format and the data transmission frequency of the units are easily selectable from preprogrammed alternatives via selected switch settings and the appropriate connection of jumpers in the individual devices. The transmitter or receiver may then be used in conjunction with the corresponding transmitter and/or receiver having the selected operating parameters, including but not limited to ASIC-based systems.

DESCRIPTION OF PREFERRED EMBODIMENTS

Figure 1:
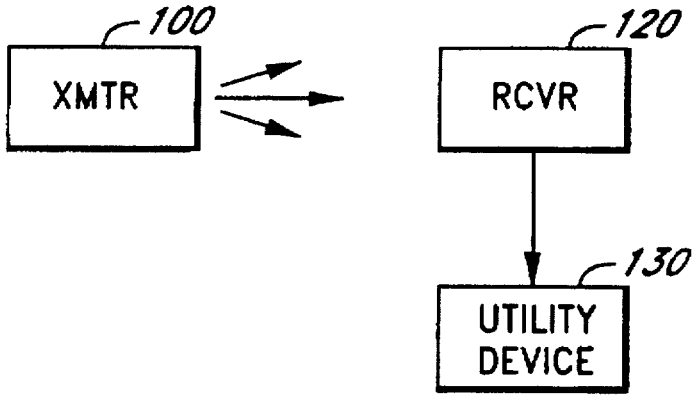
FIG. 1 is a block diagram illustrating a typical transmitter-receiver system.

Referring now to the drawings, and in particular to FIG. 1, there is shown a block diagram of a typical transmitter-receiver system. In FIG. 1, transmitter 100 is any suitable transmitter capable of generating an electromagnetic wave represented by the arrows 101. The frequency of the signal 101 generated by transmitter 100 and the encoding and data transmission scheme is a function of the particular transmitter design. A receiver 120 is adapted to receive the signals 101 from the transmitter 100, interpret the signals and produce an output signal to drive a utility device 130.

In a representative utilization, the transmitter 100 is a remote control device which can be used with the receiver 120 as part of a garage door opening system. In this representative utilization, utility device 130 may be the garage door mechanism, including the motor, drive mechanism, lighting apparatus and/or the like. The utility device 130 opens or closes a garage door (for example) when activated by receiver 120 upon receipt of the appropriate signal from the transmitter 100. While a garage door opening mechanism is illustrative, many other types of utility devices may be controlled by such remote transmitter-receiver systems.

The transmitter 100 when activated generates a signal 101 having a prescribed signal frequency and a unique data transmission format. That is, the timing parameters and modulation characteristics related to encoded data are unique to the design of the particular transmitter. The receiver 120 is adapted to receive and decode the signals generated by the transmitter 100 to produce an output signal which is supplied to the utility device 130. In the conventional transmitter-receiver system, the transmitter 100 and the receiver 120 operate at a single transmission frequency and are implemented with ASIC devices. Consequently the transmitter 100 and receiver 120 can transmit and receive only a single data transmission format and at the single transmission frequency.

The transmitter 100 and receiver 120 typically have a device code (or device address) which is selectable by setting a plurality of corresponding DIP switches in each unit. Identical device codes are required for communication between a transmitter 100 and a receiver 120. Setting the DIP switches to identical settings (on or off) in each unit provides identical device codes. Communication between the transmitter 100 and receiver 120 is accomplished according to a specific data transmission format which typically is unique to devices provided by the manufacturer of the specific transmitter-receiver system. This data transmission format is implemented with ASIC-type encoders and decoders which can transmit and receive only the single data format implemented in the ASIC circuitry.

Figure 2:
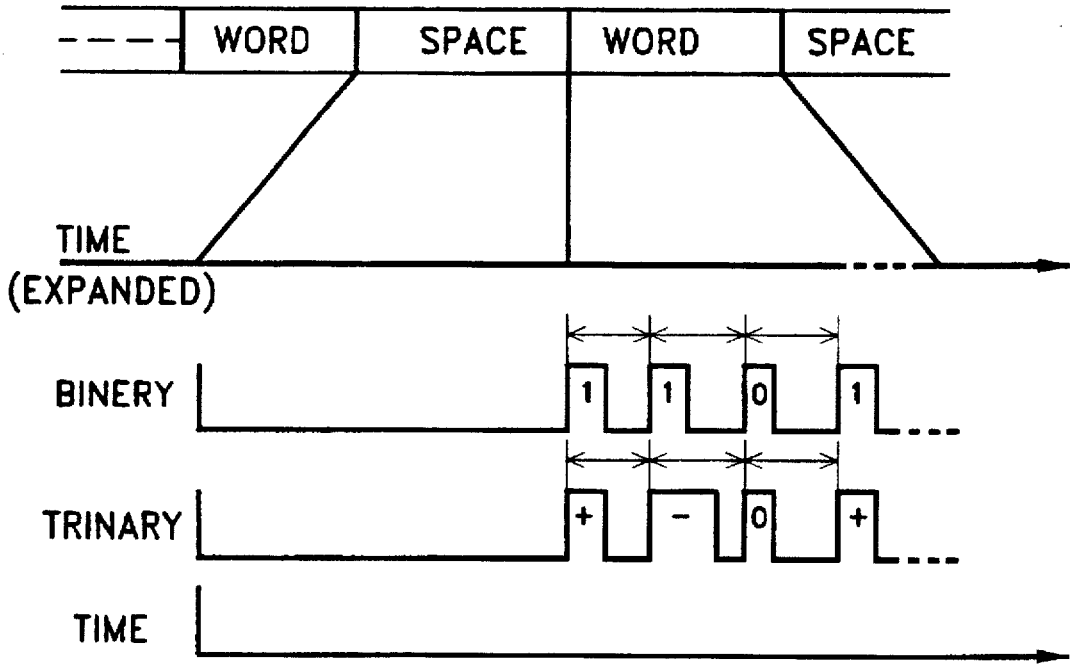
FIGS. 2–4 are graphic representations illustrating data transmission formats which are typically used in conventional transmitter-receiver systems and which may be implemented in the transmitter-receiver system of the instant invention.
Figure 3:
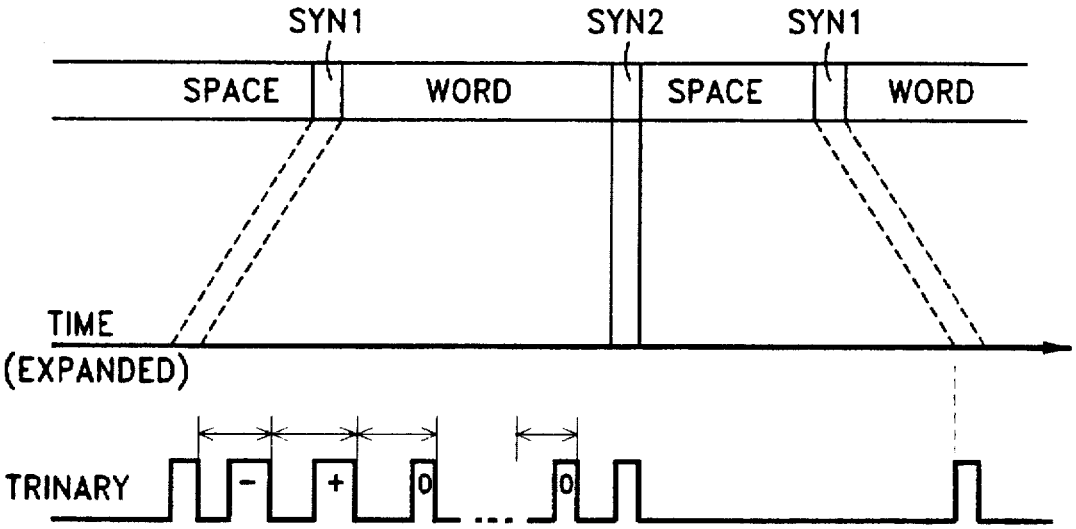
Figure 4:
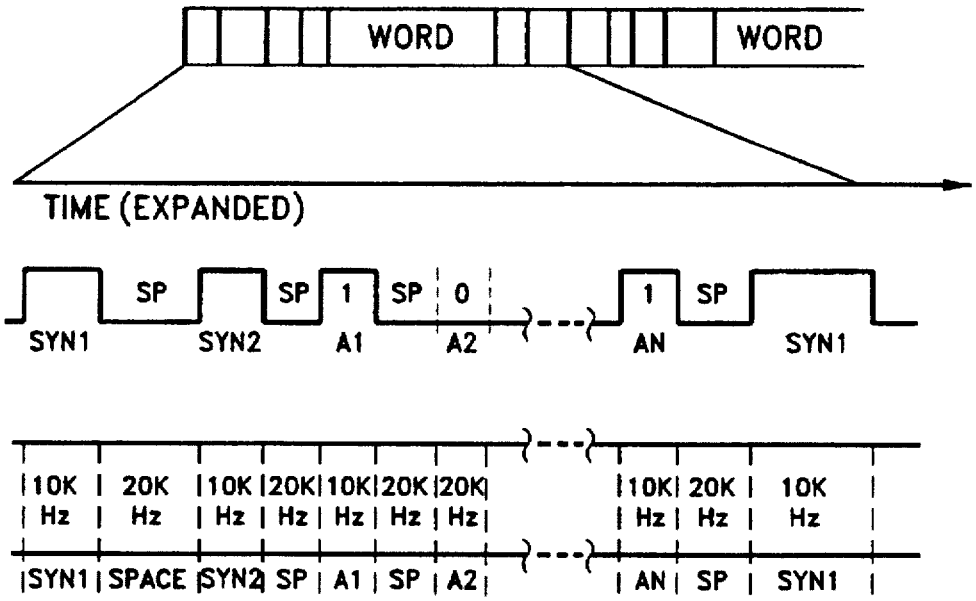

FIG. 2–4 illustrate three types of data transmission formats utilized in existing transmitter-receiver systems. In the exemplary format shown in FIG. 2, data words are transmitted separated by spaces. The length (i.e., time slot) of the separating space is typically similar to the length of a data word, although most details of the format are at the option of the designer. The data word is typically divided into equal time slots for each bit of data. In one existing binary implementation (illustrated in FIG. 2), a pulse equal to one half of a time slot represents a logical one and a pulse equal to a quarter time slot equals a logical zero. In another existing implementation (not shown), a logical one is three quarters of a time slot and a logical zero is one quarter of a time slot.

In one implementation of this type of format an eight-bit binary data word is 32 ms in length (4 ms per bit with pulses of 2.0 ms and 0.5 ms representing logical 1 and logical zero, respectively) and the data words are separated by spaces of 32 milliseconds. This format may also be thought of as a data word of 2 ms per bit with each bit separated by a space of 2 ms. In another implementation, a ten-bit data word is 20 ms in length (2 ms per bit with pulses of 1.5 ms and 0.5 ms representing logical 1 and logical zero, respectively) and data words are separated by spaces of 12 milliseconds.

FIG. 2 also illustrates a typical trinary implementation of this type of format where each bit may be a plus, a minus, or a zero. In this scheme, a plus state may be indicated by a pulse having a pulse width equal to one half of a bit time slot, a minus state by a pulse having a width of three quarters of the time slot and a zero state by a pulse width of one quarter of the time slot. Of course many variations are possible.

In the encoding schemes illustrated by FIG. 2, the transmitted waveform is a signal at the transmission frequency which is turned on and off in accordance with the pulse width of the encoded data bits. Thus, the transmitted waveform is a series of data words separated by spaces and comprising of a series of pulses at the transmission frequency having the appropriate pulse widths to indicate a logical one or a logical zero in the case of a binary system, or a plus, a minus, or a zero in the case of a trinary system.

Referring to FIG. 3, a second type of data transmission format there illustrated includes a first synchronization pulse, followed by a short space, followed by a data word, followed by a second synchronization pulse, followed by a long space, followed by another first synchronization pulse to start a second data sequence. The data word is typically divided into equal time slots for each bit of data. As in the case of the previous exemplary trinary system of the type shown and described relative to FIG. 1, a minus state may be indicated by a pulse having a width of three quarters of the pulse time slot, a plus state may be indicated by a pulse having a width of one half the time slot, and a zero state may be indicated by a pulse having a width of one quarter of the bit time slot. The transmitted waveform is, therefore, a series of pulses at the transmission frequency separated by appropriate spaces to define the synchronization pulses and the data bits.

FIG. 4 illustrates a binary encoding system employing synchronization pulses as described in connection with FIG. 3, but also incorporating a frequency shift keying (FSK) format. In the binary FSK system illustrated, signals such as synchronization pulses and logical one data bits are represented by a signal at a first frequency (such as ten KHz). Spaces and logical zeros are represented by a second frequency (such as twenty KHz). The transmitted waveform is therefore a signal at the transmission frequency which is turned on and off at the first frequency or the second frequency, as appropriate, in accordance with the pulse width of the encoded data bits, the synchronization pulses and the spaces.

The described data transmission formats are employed in existing transmitter-receiver systems. In order to selectively transmit and/or receive in one of the above formats or in different formats, the transmitter and receiver of the instant invention each employ a programmable microcontroller to selectively provide operation in a plurality of data transmission formats.

Figure 5:
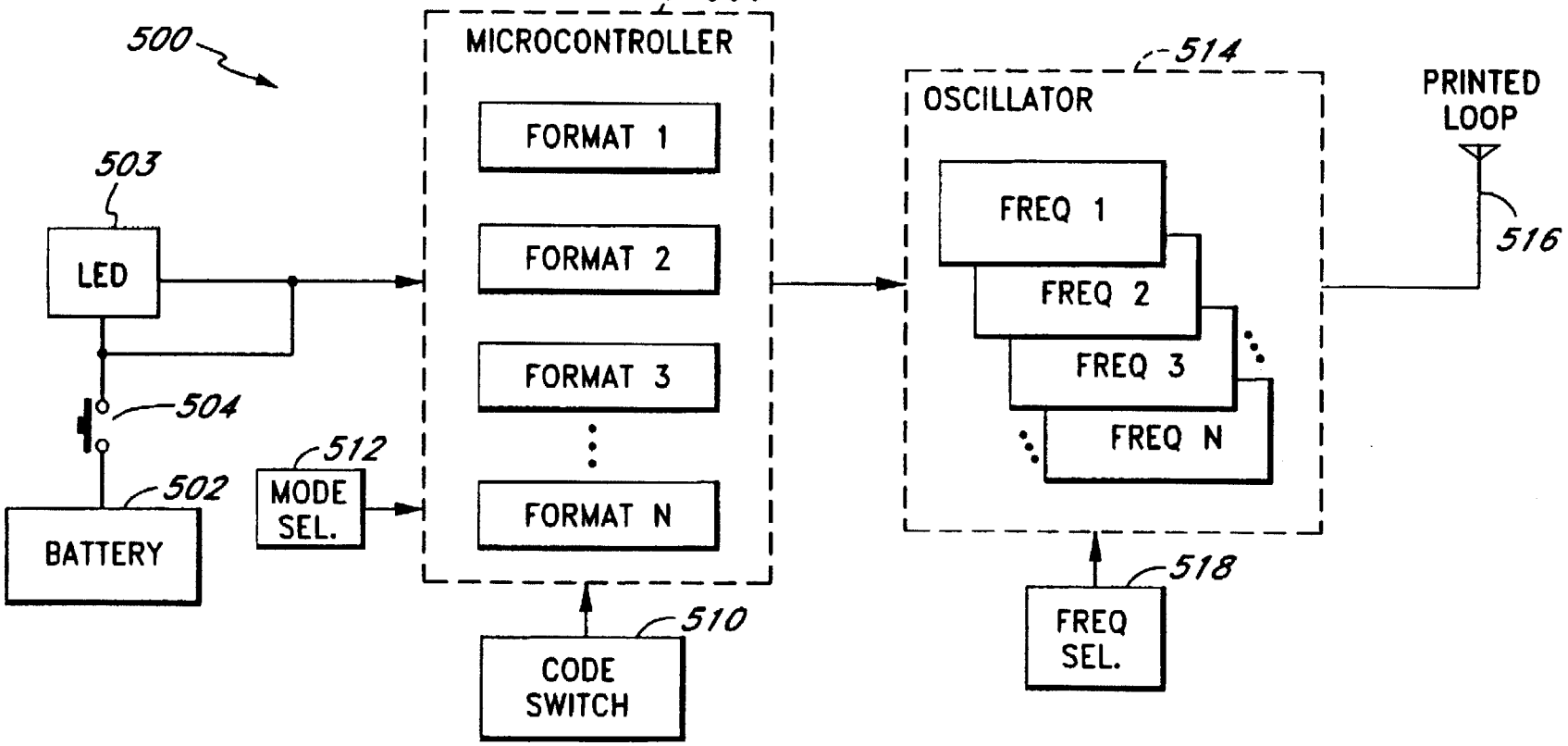
FIG. 5 is a block diagram of a transmitter according to the instant invention.

Referring now to FIG. 5, there is shown a high level block diagram of transmitter 500 according to the present invention which may selectively emulate the operation of the transmitter of a plurality of other transmitter-receiver systems. Power is supplied to the transmitter circuitry by a suitable power source such as lithium battery 502. The power is applied by actuating a momentary contact switch 504 which couples power to a microcontroller 506 via a battery status indicator such as a light emitting diode (LED) 508. The microcontroller 506 is a programmable unit which can be programmed to selectively effect the same data transmission format as other transmitter-receiver systems. Many programmable integrated circuits, such as are available from NEC, Motorola or Texas Instruments, Inc., are suitable for use as microcontroller 506 in the present invention as will be recognized by persons in the art.

The microcontroller 506 operates to selectively generate an output signal having one of a plurality of data transmission formats or modes of operation. A code switch 510 selects a device code for the transmitter 500 and provides appropriate inputs to the microcontroller. Similarly, a mode select control 512 provides control signals to the microcontroller 506 to control the program operation of the microcontroller 506 to provide the selected data transmission format. The output of the microcontroller is typically a serial pulse train containing the data word and any required synchronization or timing pulses. The microcontroller 506 produces an encoded signal similar to the signal which would be produced by the individual ASIC encoders or other kinds of integrated circuits. Since the output wave shape of the microcontroller 506 is determined by the programming of the microcontroller, the output wave shape may be easily modified or varied as required to provide virtually any format including the formats of FIGS. 2–4 and variations thereof. The operation of the microcontroller 506 will be described more fully in connection with FIGS. 10–12 hereinafter.

The serial pulse train produced at the output of microcontroller 506 is coupled to an oscillator 514 for transmission of the encoded signal via a printed loop antenna 516. The oscillator 514 is turned on and off in accordance with the serial pulse train to transmit a series of pulses as defined by the microcontroller output wave shape. One of a plurality of transmission frequencies may be selected by frequency select control 518 which selects the frequency of the oscillator 514.

Once the code switch 510, the mode select control 512 and the frequency select control 518 have been set, the transmitter 500 will generate an output signal having a selected device code, a selected data transmission format and a selected data transmission frequency. Thus the microcontroller transmitter 500 may emulate the transmitters of other transmitter-receiver systems or may operate with any format which may be generated by the microcontroller.

Figure 6:
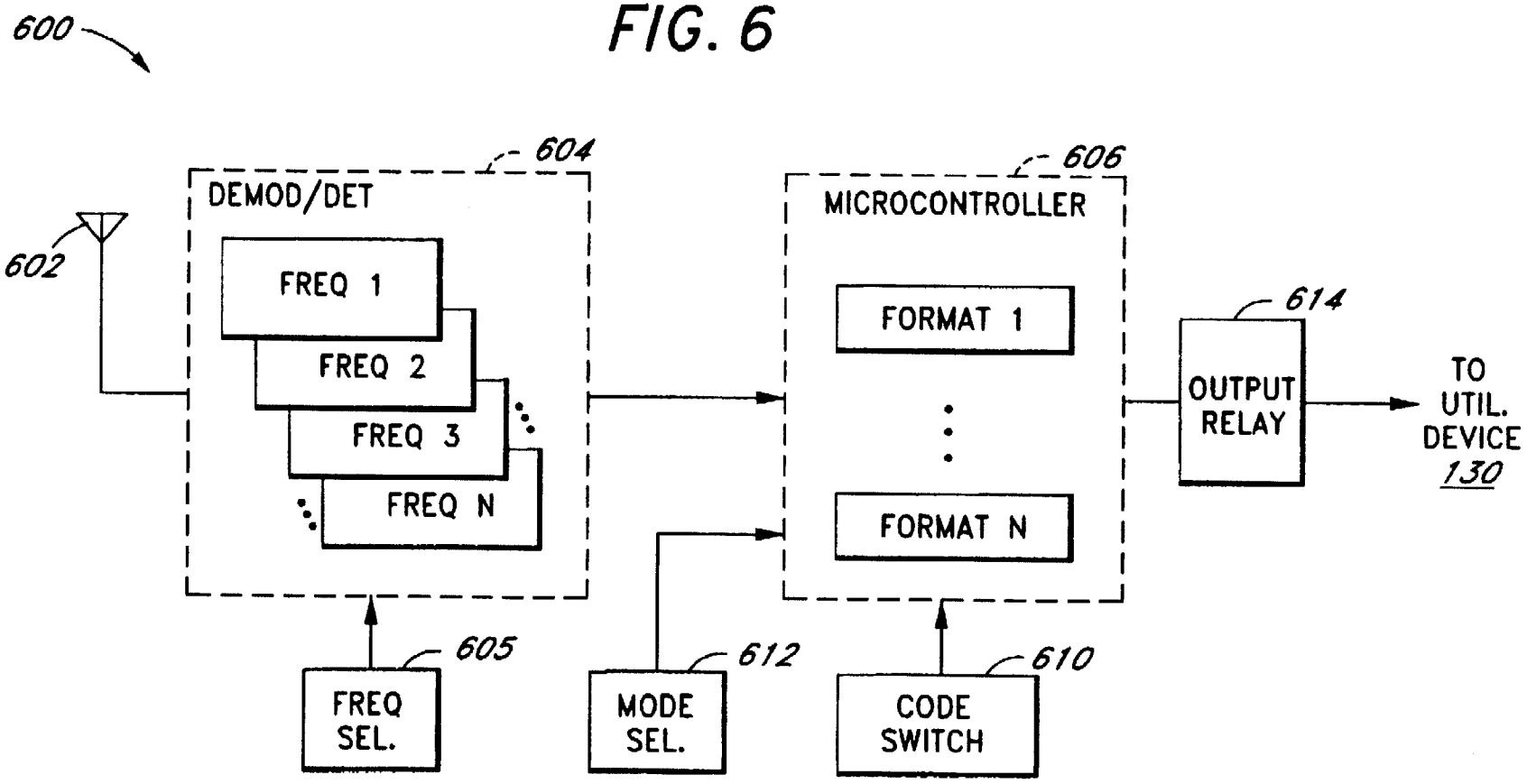
FIG. 6 is a block diagram of a receiver according to the instant invention.

FIG. 6 is a is a high level block diagram of a receiver 600 according to the present invention which may selectively emulate the operation of the receiver 120 of other transmitter-receiver systems of the type shown and described relative to FIG. 1. The signal is received by printed loop antenna 602 and coupled to a demodulator/detector 604 for removing the transmission frequency and detecting the transmitted data. The frequency of the oscillator demodulator/detector 604 is selected by frequency select control 605. The detected data, a serial pulse train, is coupled to microcontroller 606 which corresponds to the microcontroller 506 in the transmitter 500.

The microcontroller 606 is programmed to decode an input signal having one of a plurality of data transmission formats. A device code select switch 610 and a mode select control 612 provide inputs to control the operation of the microcontroller program to decode the pulse train according to the appropriate data transmission format and device code. The microcontroller 606 decodes the received data and generates an output signal which is coupled via relay 614 to actuate the utility device 130.

Thus, once the code select switch 610, the mode select control 612 and the frequency select control 605 have been set, the receiver 600 may emulate the receiver of an existing transmitter-receiver system or operate with any format that may be decoded by the microcontroller.

Figures 7, 7A:
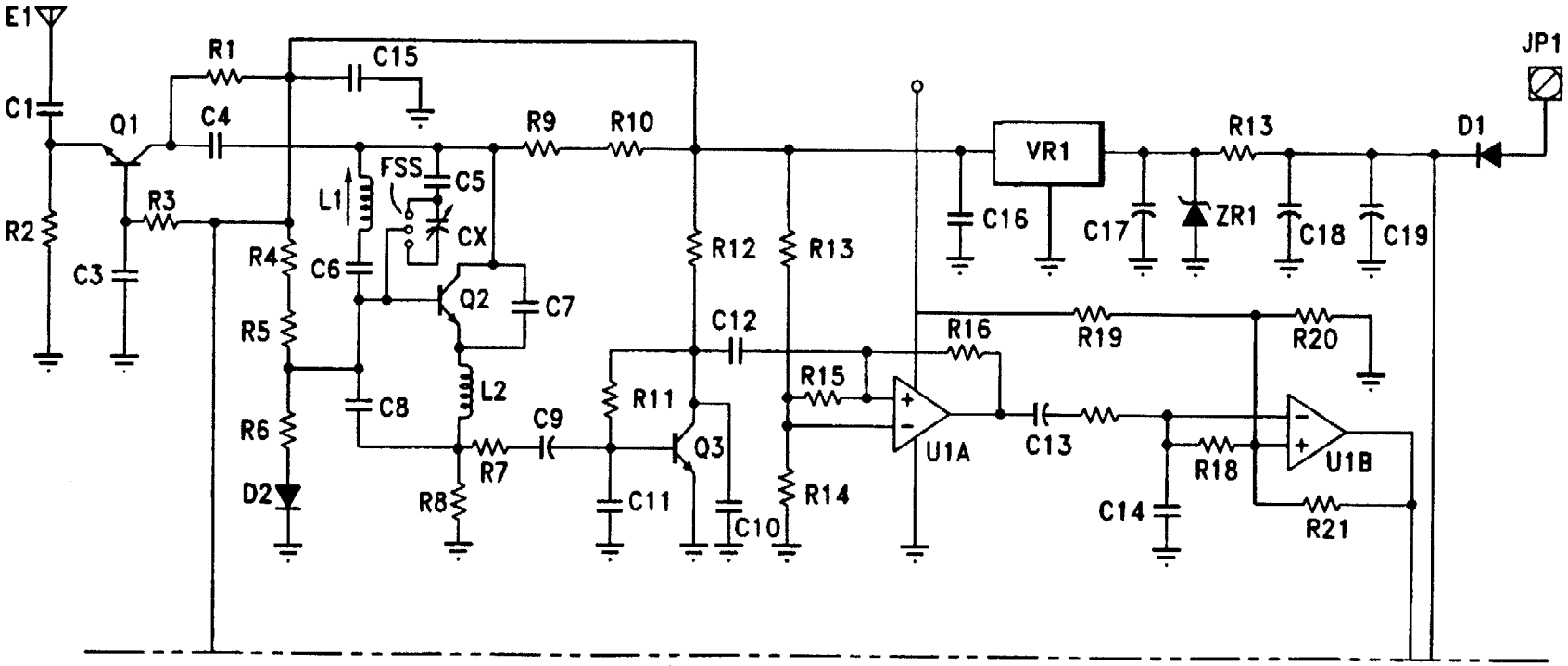
FIG. 7 is a schematic diagram of a preferred embodiment of a receiver according to the present invention.
Figure 7B:
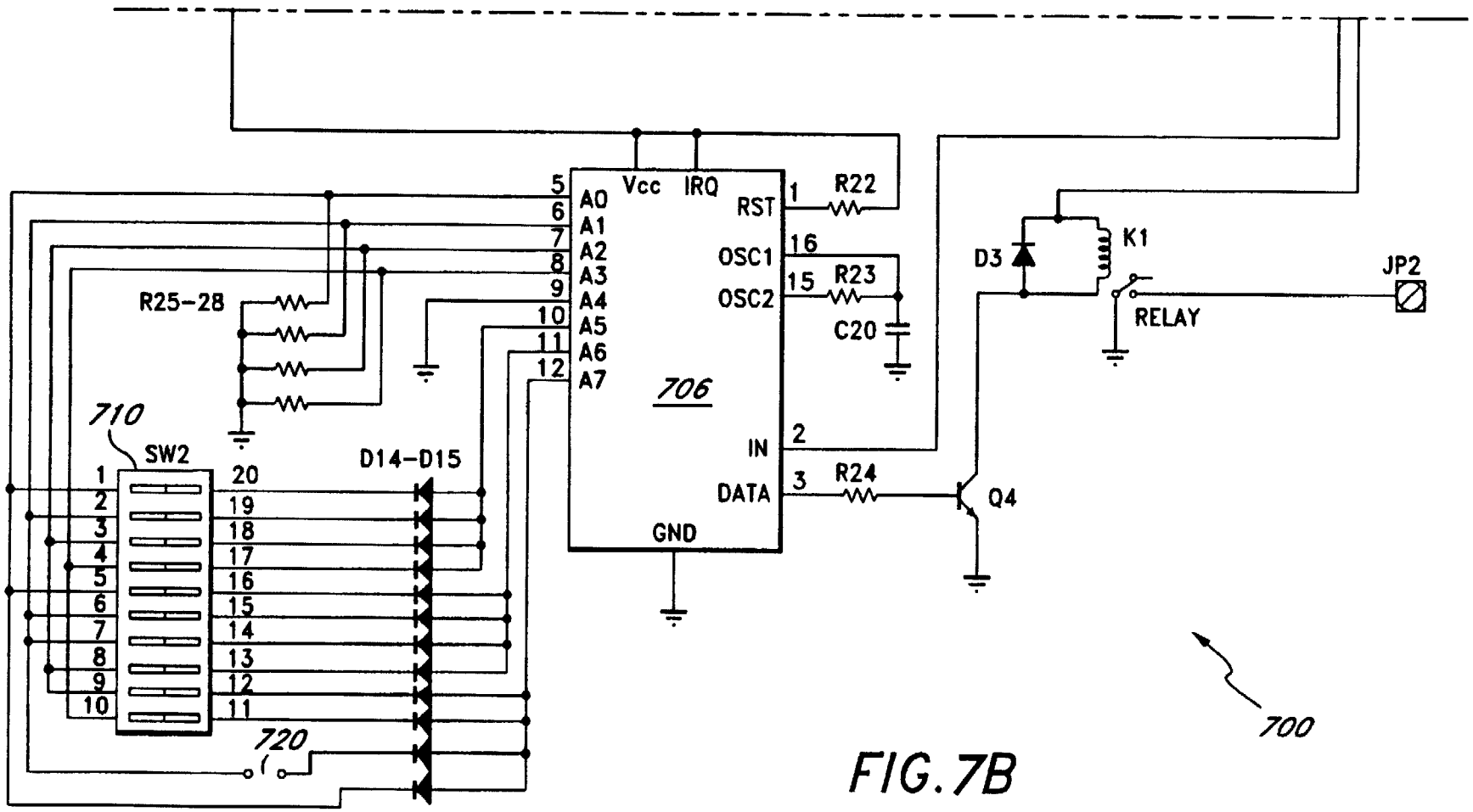
Figure 8:
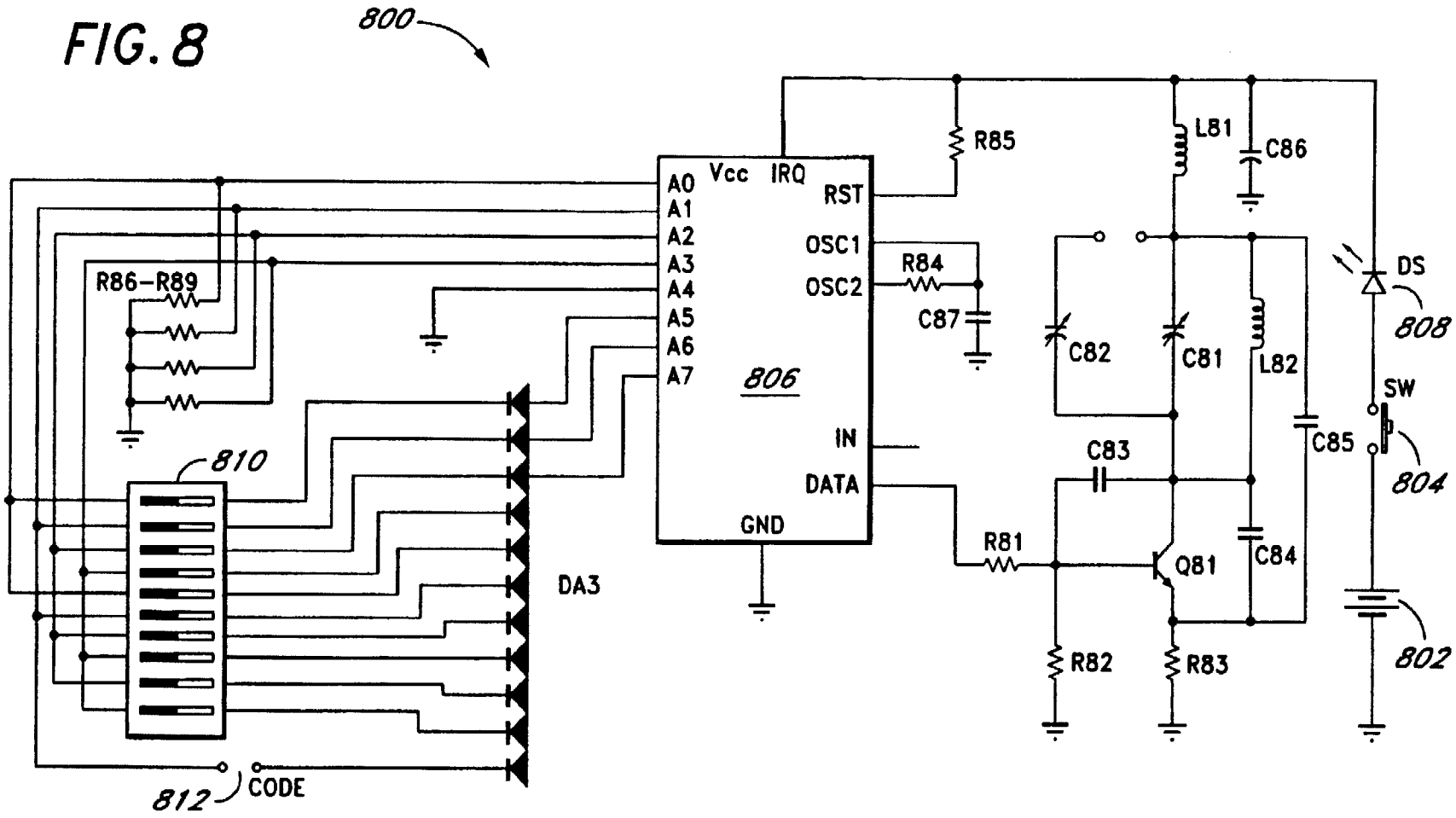
FIG. 8 is a schematic diagram of a preferred embodiment of a transmitter according to the instant invention.
Figures 9, 9A:
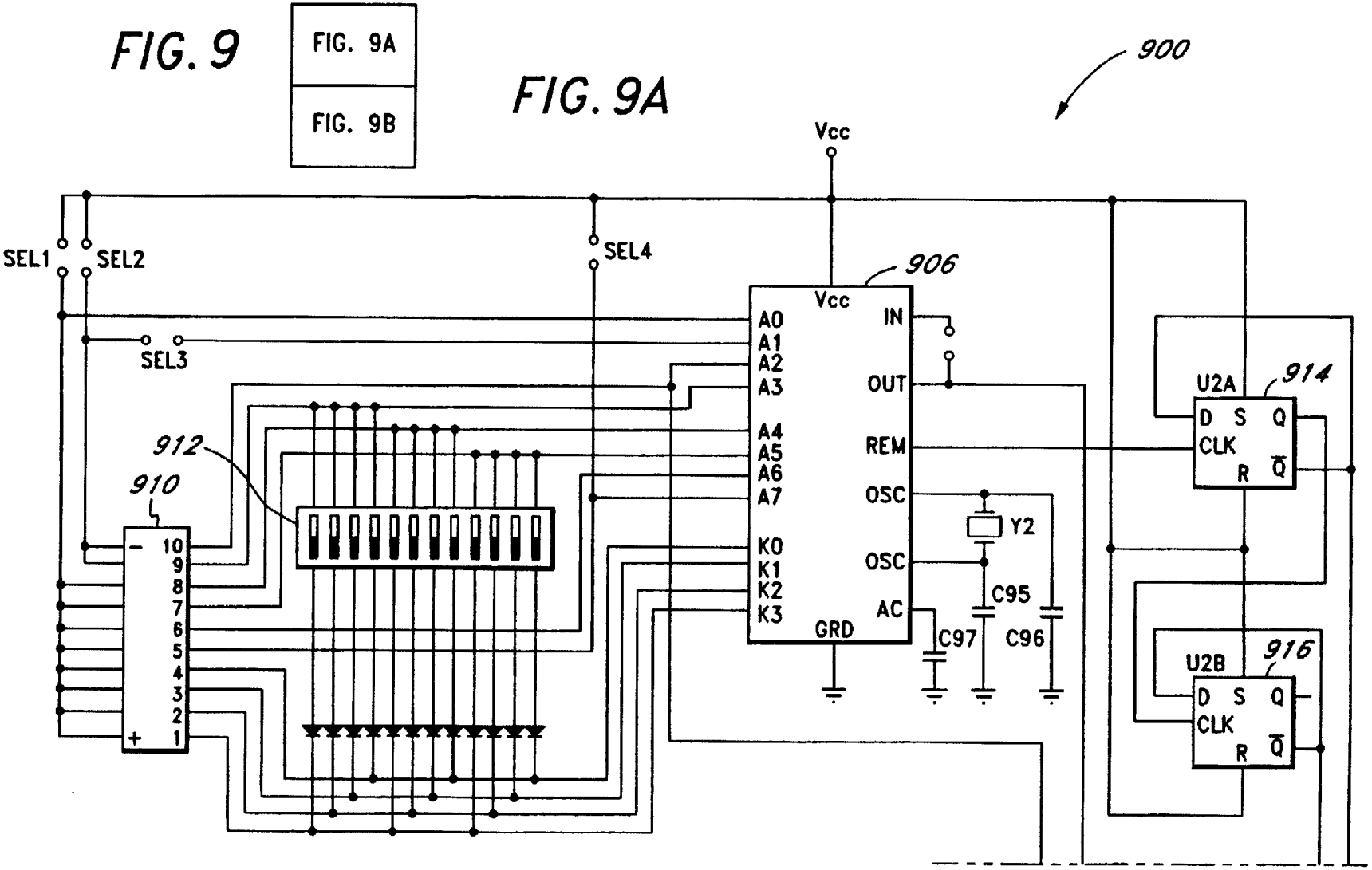
FIG. 9 is a schematic diagram of an alternate preferred embodiment of a transmitter according to the present invention.
Figure 9B:
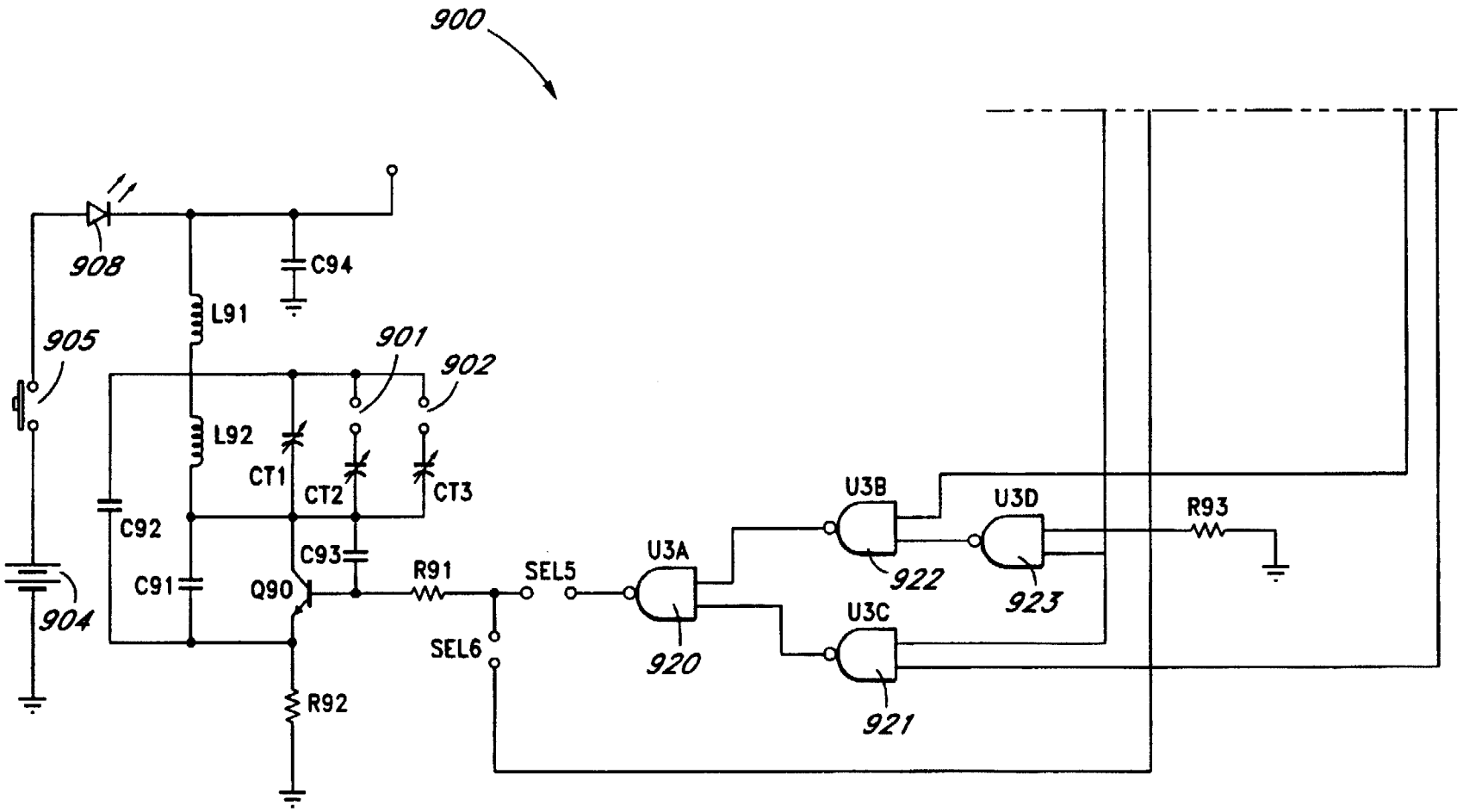

FIGS. 7, 8, and 9 illustrate separate embodiments of the invention. FIG. 7 is a schematic diagram of an operative embodiment of a receiver 700 having two data transmission formats and operating at two transmission frequencies. The receiver 700 includes a power supply which includes voltage regulator VR1. The regulator VR1 is connected to a suitable power source at the junction point JP1. The receiver 700 includes a suitable antenna E1 which is connected to one stage of RF amplification (including transistor Q1 in conventional configuration). The RF network is connected the local oscillator (LO) including transistor Q2, inductor L1, capacitors C6 and C5 and variable capacitor Cx. The frequency of the local oscillator is a function of the capacitance connected in series with and/or in parallel with the inductor L1.

A frequency select switch FSS provides for the selection of one of two local oscillator frequencies by changing the capacitance in the local oscillator circuit. A jumper may be connected across the terminals of switch FSS to selectively connect the variable capacitor Cx in series with capacitor C5 to allow the selection of the local oscillator frequency to conform to the frequency of the received signal. It will be recognized that the use of a variable capacitor allows the frequency of the local oscillator to be fine tuned through a range of frequencies. It will also be recognized that multiple frequencies are achievable by providing for further variation of the capacitance of the=local oscillator circuit. In the instant embodiment, for any set value of capacitor Cx, the positioning of the jumper across the terminals of switch FSS allows the selection of one of two LO frequencies. The local oscillator is connected to a demodulating circuit including transistor Q3 for amplification and for demodulation of the output signal from the local oscillator.

The demodulated signal is supplied through appropriate detector circuits U1A and U1B to the data input of a microcontroller 706. The data input signal to the microcontroller 706 is a train of pulses having a specific format as generated by the transmitter 600. The microcontroller 706 is also coupled to DIP switch 710 (a 10 bit switch is shown) for reading a device code into the microcontroller. The microcontroller interrogates the positions of the DIP switches by multiplexing output signals from ports A4–A7 and receiving corresponding input signals over ports A0–A3. Of course, additional switches 710 may be utilized for larger or more complicated codes.

The microcontroller 706 is programmed to decode the received pulse train which contains the device code of the transmitter 600, compare the decoded device code (address) of the transmitter with the device code (address) of the receiver 700 as set by the individual positions of the DIP switch 710, and provide a data output signal at the DATA terminal when the device code of the transmitter and receiver are identical. When the device codes are identical, a data output signal from the microcontroller 706 is coupled to activate transistor Q4.

The microcontroller may be programmed to decode pulse trains having multiple data transmission formats. Control inputs which are provided to the microcontroller 706 select processing appropriate for the format of the incoming signal. In the receiver of FIG. 7, the microcontroller 706 is programmed to decode input data received in two formats. The control input is provided by the presence or absence of a jumper across the "code" terminals 720 which couples output port A7 to input port A1 for interrogation by the microcontroller. The resulting control input status selects the appropriate processes in the microcontroller 706 to decode the received signal.

When transistor Q4 is turned-on, a circuit is completed through coil of the relay K1. Activation of the relay K1 moves the armature of the relay and connects output terminal JP2 to ground, thereby applying a voltage between the input terminal JP1 and terminal JP2. This voltage is thus available to actuate the operation of a utility device such as a garage door opening system.

FIG. 8 is a schematic diagram of a transmitter 800 which corresponds to the receiver 700 of FIG. 7 in that it has two data transmission formats and operates at two different transmission frequencies. Closure of switch 804 applies power from the battery 802 to the transmitter circuitry. An LED 808 or similar device is coupled in the circuit to indicate that the switch 804 has been closed and that the battery is operative. DIP switch 810 functions as the device code select switch for reading the device code into a microcontroller 806. As in the receiver 700, the microcontroller 806 interrogates the positions of the DIP switches by multiplexing output signals from ports A4–A7 and receiving corresponding input signals over ports A0–A3. Similarly, control inputs are provided to the microcontroller 706 to identify the format of the signal to be generated.

Microcontroller 806 is programmed to encode output data in two formats. The control input selecting the appropriate data transmission format is provided by the presence or absence of a jumper across the "code" terminals 812 which couples output port A7 to input port A1 for interrogation by the microcontroller. The resulting control input status selects the appropriate encoding processes in the microcontroller for generating an output signal of the selected format.

The output signal, in the form of a pulse train (i.e., serial data) having the selected format and containing the appropriate device code, is then coupled from the DATA terminal of microcontroller 806 to the base of transistor Q81 to turn the transmitter output oscillator circuit on and off. The pulse train selectively activates the output oscillator to provide a transmitted signal through antenna coils L81 and L82. The transmitted output of the oscillator is a signal with required data transmission format at the frequency of the oscillator. The output frequency generated across the inductor (or transmitter coil) is a function of the capacitance connected in series with and/or in parallel with the respective coils. As in the case of the receiver of FIG. 7, the frequency can be changed by alteration of the frequency jumper 814.

Referring now to FIG. 9, there is shown an alternative transmitter configuration 900 having five selectable data transmission formats and three selectable transmission frequencies. The transmission frequency is selected by means of jumpers selectively connected at terminals 901 and 902 which select the capacitance in the output oscillator circuit including transistor Q90 inductors L91 and L92 and capacitors CT1 in combination with CT2 and/or CT3. The device code data transmission format are selected based on the settings of DIP switch 910 (a twelve bit switch) and second DIP switch 912 (a 10 bit switch) and the selective connection of jumpers across terminals SEL 1, SEL 2, SEL 3, SEL 4, SEL 5, and SEL 6.

In the case of a data format such as shown in FIGS. 2 and 3, the data out port of the microcontroller 906 is coupled by terminals SEL 6 to the base of transistor Q90 to modulate the operation of the output oscillator according to the desired wave form. When an FSK type output signal such as shown in FIG. 4 is required, the REM output of the microcontroller 906 may be used. The REM output (in this particular microcontroller) is a 40 KHz signal having an envelope identical to the serial pulse train present at the DATA terminal of the microcontroller 906. Flip-flops 914 and 916 serve as divide by 2 and divide by 4 circuits, respectively, to convert the pulses from the 40 KHz REM output to the 20 KHz signals and the 10 KHz signals required for the FSK format. The Q outputs from the flip-flops are coupled to Nand gates 922 and 923, respectively, to selectively turn the output oscillator on and off at the 20 KHz or 10 KHz rate as required by the data transmission format.

Figure 10:
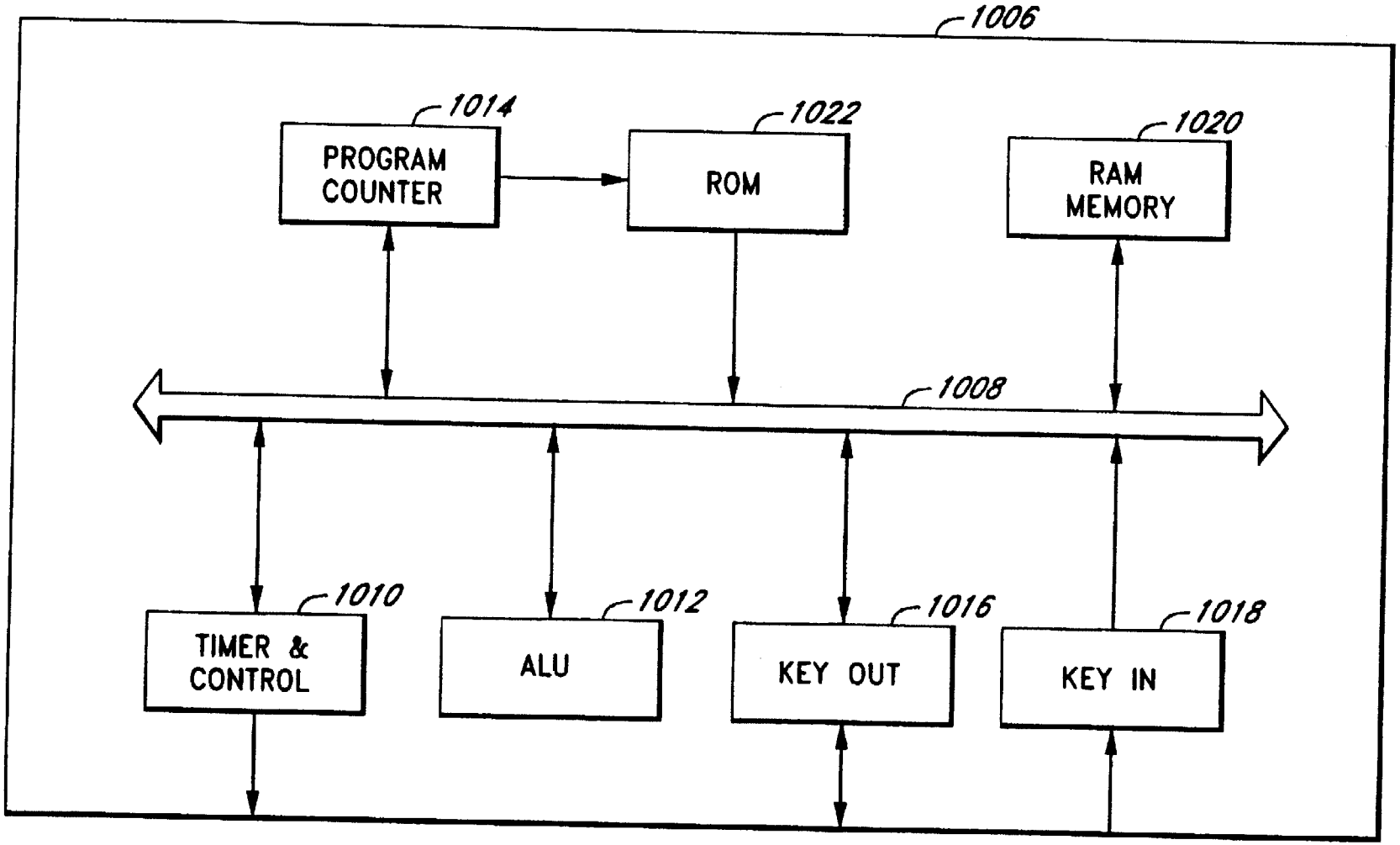
FIG. 10 is a simplified block digram of a typical microcontroller.
Figure 11:
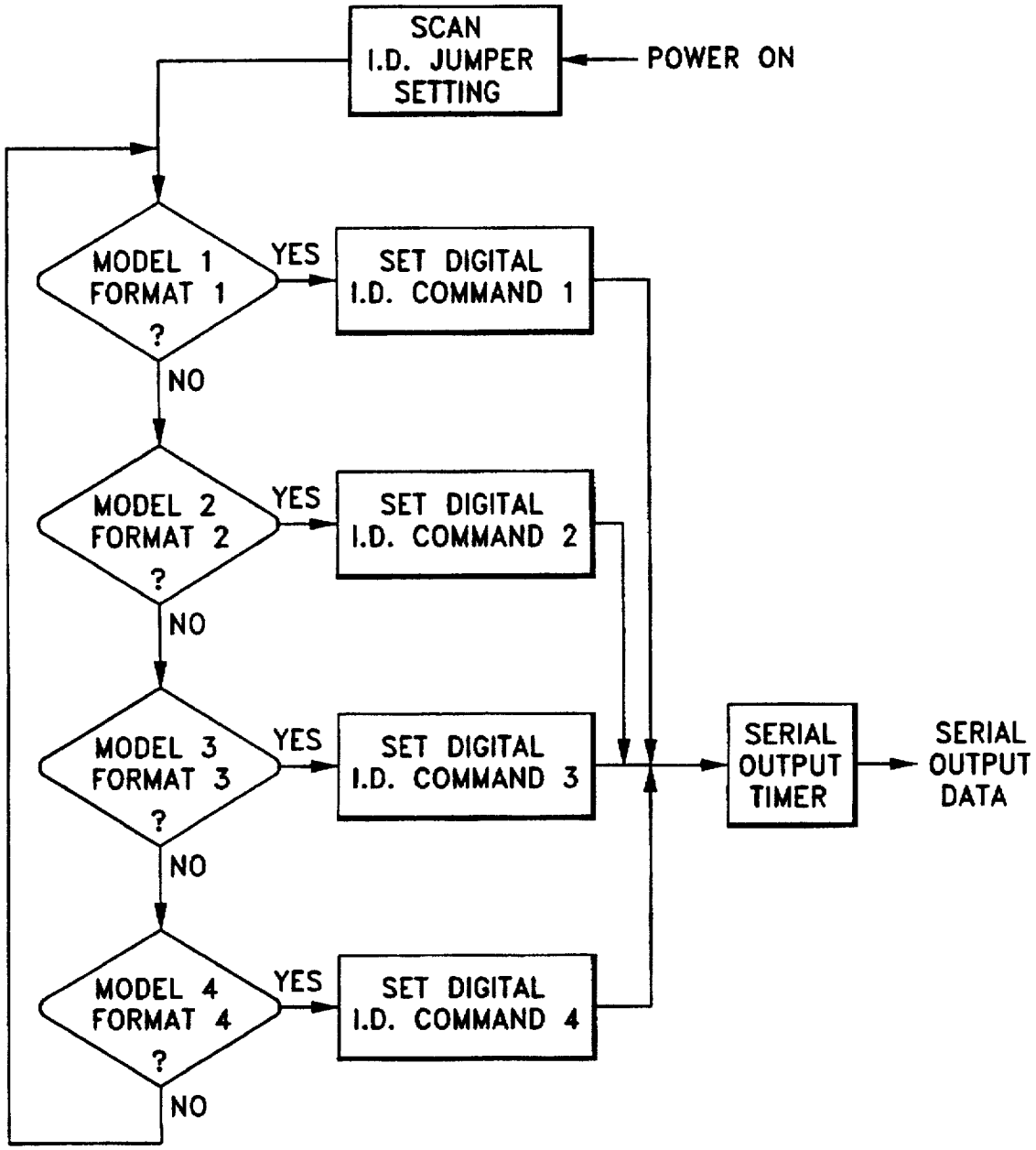
FIGS. 11 and 12 are flow diagrams illustrating the processes carried out in the transmitter microcontroller and the receiver microcontroller, respectively.
Figure 12:
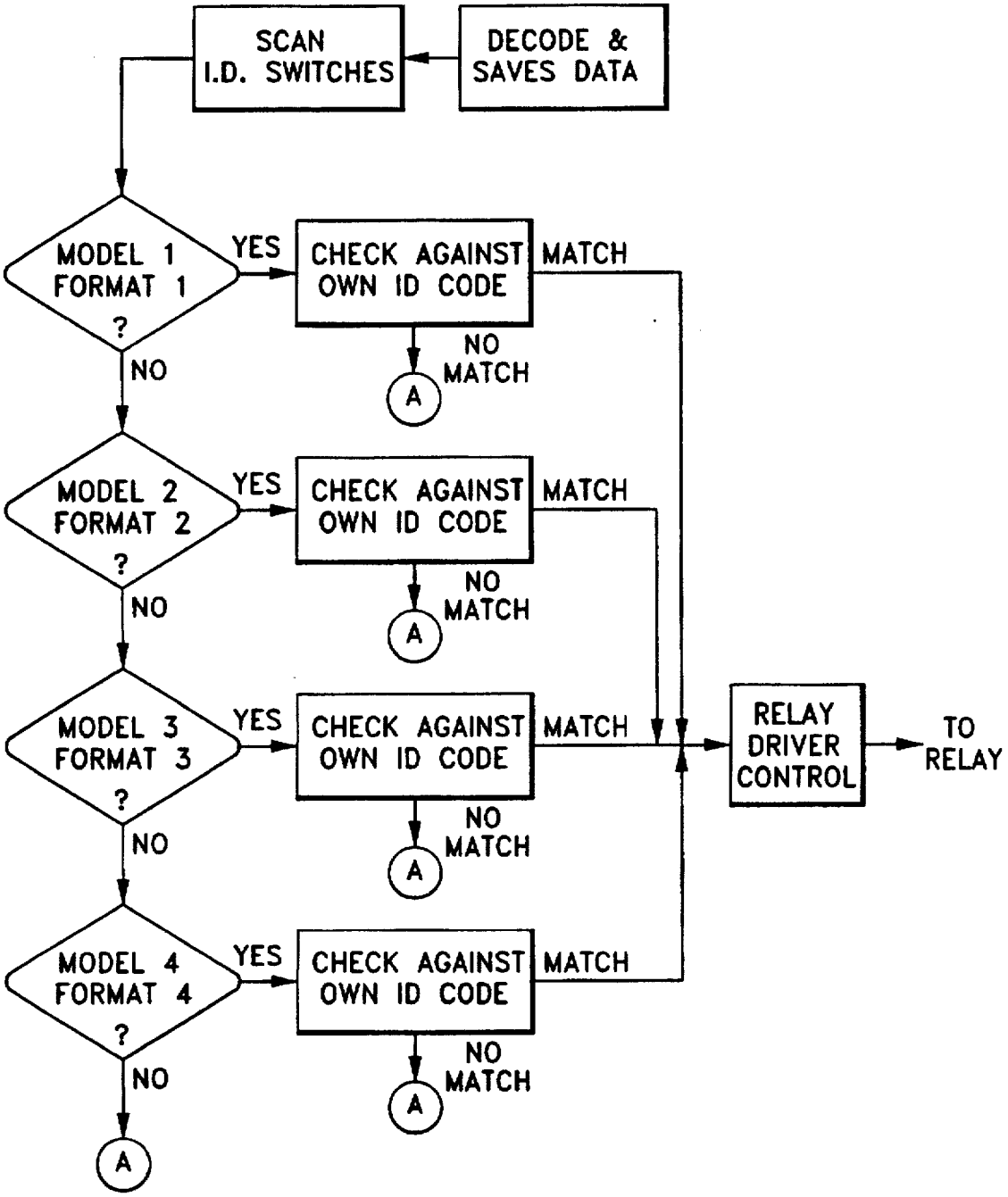

Referring now to FIGS. 10–12, FIG. 10 is a simplified block diagram of a typical conventional microcontroller 1006 such as is contemplated for use in the transmitter and receiver of the present invention. The microcontroller 1006 includes data bus 1008 coupled to enable communication between a timing and control unit 1010, an arithmetic logic unit (ALU) 1012, a program counter 1014, a key-out unit 1016, a key-in unit 1018, random access memory (RAM) 1020, and a read only memory (ROM) 1022. The program counter 1014 is coupled directly to the ROM 1022 and the timing and control unit 1010. The key-out and key-in units 1016 and 1018 may be coupled to receive external signals.

Turning now to the flow diagram of FIG. 11, the transmitter microcontroller operates as follows in the following manner. Upon the application of power, the program counter 1014 executes instructions in ROM 1022 to scan the logic blocks of the key-out unit 1016 and the key-in unit 1018 to determine external inputs to the microcontroller (i.e., read the chosen device code and the chosen data transmission format or mode). This data is stored in RAM 1020. The DIP switch settings are used to select the chosen device code and jumper settings are used to select the chosen data transmission format.

Next the program counter 1014 fetches the next group of sequential instructions in ROM 1022 to determine the format of the inputted data. This is done by comparing the fetched data in the ROM instruction with the data stored in the RAM 1020. Both of these data are transferred to the ALU 1012 for data comparison. Once the selected format is determined, a new digital command is written back to a location in RAM for outputting. The program counter 1012 then fetches the next group of ROM instructions which transfer the command to the timing and control unit for actual outputting of the serial pulse train.

Referring to FIG. 12, the microcontroller receiver operates in a similar manner to the microcontroller transmitter to decode the received signal. The program counter fetches instructions in ROM to instruct key-in and key-out blocks to scan DIP switch settings, jumper settings, and serial data input. This information is stored in designated locations in RAM. Upon detecting serial data valid, this data is saved in RAM for further processing to determine its device code and format information. The next instruction group transfers the serial data in the RAM to the ALU for actual comparison.

If the received device code matches the receiver's device code (i.e., DIP switch setting) and if the received data matches the receiver format (jumper setting), the ALU sends a unique data bit to the RAM to indicate a match. The next sequential instruction from the ROM transfers this unique data bit to the timing and control block for outputting to drive a relay control (such as relay K1 of FIG. 10).

While the preceding description has been directed to particular embodiments, it is understood that those skilled in the art may conceive modifications and/or variations to the specific embodiments and described herein. Any such modifications or variations which fall within the purview of this description are intended to be included therein as well. It is understood that the description herein is intended to be illustrative only and is not intended to limit the scope of the invention. Rather the scope of the invention described herein is limited only by the claims appended hereto.

I claim:

1. In a transmitter-receiver system in which a transmitter transmits a coded signal to a receiver, the coded signal having a transmission format and is transmitted at a frequency, said transmitter comprising:

a plurality of switches that are selectable to provide an address;

a first circuit having a plurality of input terminals that are selected to provide one of a plurality of output signals, each of which is representative of a different data transmission format;

a microcontroller coupled to said plurality of switches and said first circuit, said microcontroller generates a coded signal in the selected data transmission format, said coded signal including the selected address; and a second circuit coupled to said microcontroller, said second circuit having a plurality of input terminals that are selected to provide one of a plurality of transmission frequencies, said second circuit transmits said coded signal at the selected transmission frequency.

2. The transmitter of claim 1, wherein said plurality switches are switches located within a dual inline package switch.

3. The transmitter of claim 1, wherein said first circuit comprises two input terminals that provide a first output signal representative of a first data transmission format when closed, and provide a second output signal representative of a second data transmission format when open.

4. The transmitter of claim 3, wherein the two input terminals of said first circuit are coupled by a jumper.

5. The transmitter of claim 1, wherein said second circuit comprises:

an oscillator circuit that provides one of said plurality of transmission frequencies, said oscillator circuit having two input terminals that provide a first transmission frequency when closed and provide a second transmission frequency when open; and an antenna for transmitting the coded signal at the selected transmission frequency.

6. The transmitter of claim 5, wherein the two input terminals of said oscillator are coupled by a jumper.

* * * * *